United States Patent [19]

Hicks et al.

[11] 4,236,696

[45] Dec. 2, 1980

[54] MULTICAPSTAN TRACTION UNIT

[75] Inventors: Raymond J. Hicks, Powys, Wales; John T. H. Webb, Sunningdale, England

[73] Assignee: Wharton Engineers (Elstree) Limited, London, England

[21] Appl. No.: 870,538

[22] Filed: Jan. 18, 1978

[30] Foreign Application Priority Data

Jan. 20, 1977 [GB] United Kingdom ..... 2399/77

[51] Int. Cl.[3] ..... B66D 1/76

[52] U.S. Cl. ..... 254/297; 74/750 R 254/311

[58] Field of Search ..... 254/175.7, 175.5, 183, 254/185 R, 185 B, 150 R; 242/54 R, 47.08; 226/108, 111; 187/27; 74/750 R, 230.17 R, 660, 665 G, 665 GE, 665 R, 218, 355, 404; 192/12 R

[56] References Cited

U.S. PATENT DOCUMENTS

| | | | |
|---|---|---|---|
| 488,001 | 12/1892 | French | 254/183 |
| 3,020,022 | 2/1962 | Turnquist | 254/175.7 |
| 3,092,370 | 6/1963 | Kennedy | 254/185 |
| 3,460,807 | 8/1969 | Prikhodko et al. | 74/750 R |
| 3,776,519 | 12/1973 | Hamilton | 254/175.7 |
| 3,966,170 | 6/1976 | McKenna | 254/175.7 |

*Primary Examiner*—Robert J. Spar
*Assistant Examiner*—Kenneth Noland
*Attorney, Agent, or Firm*—Arnold, White & Durkee

[57] ABSTRACT

The traction unit comprises two pairs or sets of two or more capstans. The capstans of each pair or set have a common axis and the axes of each pair or set are in spaced apart parallel relationship. One of the capstans of each pair or set is larger in diameter than the other or one of the other capstans of the respective pair or set of capstans. Cycloidal gears, preferably an epicycloidal gear drive, is provided between the capstans of each pair or at least two of the capstans of each respective set, with one of the capstans of one pair or set being strapped to a capstan of the other pair or set of capstans or a differential coupling/load-power transmission is provided between a capstan of one pair or set and a capstan of the other pair or set.

25 Claims, 14 Drawing Figures

Figure 1:
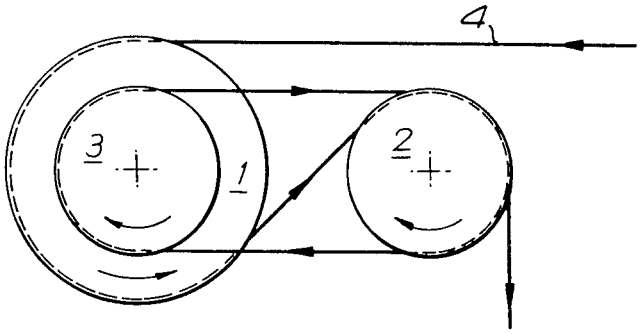

6
28
29
30
45
8
50
31
32
33
51
46
35
38
18
43
41
23
27
44
36
49
48
42
37
26
40
24
21
22
20
19
39
34
25
17

6
28
29
30
45
8
50
31
32
33
18
43
41
23
27
49
48
26
42
37
24
21
22
20
19
25
17
52

MULTICAPSTAN TRACTION UNIT

This invention relates to an improved traction unit comprising at least four capstans.

In our British Pat. Specification No. 1,492,744 we have described and claimed a triple capstan winch. It has now been found that the use of four capstans mounted in two pairs of two (each pair being on a common axis) has distinct advantages not previously contemplated or expected and such distinct advantages are likewise obtained by the use of six capstans mounted in two sets of three (each set being on a common axis).

According to the present invention there is provided a traction unit which comprises two pairs or sets of at least two capstans, the capstans of each pair or set having a common axis and the axes of each pair or set being in spaced apart relationship, one of each pair or set being larger in diameter than and being contra-rotatable to the other or others of that pair or set, a cycloidal gear drive being provided between the larger in diameter capstan and the other of the pair or at least one other of the set, with a differential coupling/load-power transmission between at least one capstan of each pair or set. Advantageously, the pairs or sets of capstans are identical although this is not necessary. In certain circumstances, one could have better power distribution if one graded the capstan sizes; for example a first pair could have respective radii of 20 and 14 units and the second pair have respective radii of 18 and 12 units, approximately.

During the course of development of a range of sizes of triple capstan traction units, the relationship between the three capstans was found such that the torque relationship was in the approximate ratio of 3:2:1. This gave an indication that there might possibly be a natural progression in the range of epicyclic units where the medium size or middle epicyclic of one size was suitable for the larger size of the next traction unit down and so on, using an epicyclic gear box. The alternative to this was to have a range of standard winch units not related in any way one to the other. This latter alternative lead to the investigation of the possibility of standardisation of individual components between the respective capstans themselves. This in turn lead to a consideration of the possibility of balancing the torque to each of the capstans in such a way as to optimise on the components of the epicyclic gear box, or other suitable cycloidal gear box, itself. Since it was not possible to balance the torque on each of the capstans in the triple capstan format, consideration was given to the use of four capstans. The change in the necessary degrees of wrap was carefully worked out.

In a traction unit according to the present invention having four capstans, the torque balance produced by the introduction of two cycloidal gear drives, preferably epicyclics, ensures that the rotation is correct and the unit is stable and the two pairs of capstans strapped together.

Whilst the addition of a further capstan, over a triple capstan traction unit, increases in some respects the number of units involved, the standardisation and the balanced torque input achieve an overall reduction in gear transmission requirements and a consequent saving in production costs, together with an improved performance overall on wire rope life. Thus, a reduction in percentage load on each capstan thereby allows considerable reduction in the size of gears as well as a reduction in capstan diameters. Rope is able to pass round the smaller capstans without damage due to the lowering of the loads. Balancing of the loads between the two pairs of capstans, for example 45%/55%, means that the chain or other strapping between the two pairs or sets of capstans takes only 5 or 10% of load.

A traction unit according to the present invention having four capstans has a considerably improved cost effectiveness over and above a twin capstan winch, when one considers weight, size and efficiency. For example, a four capstan winch in accordance with the present invention is less than half the weight of a corresponding twin capstan winch with given wire criteria and about the same weight as a triple capstan winch but is in fact cheaper to make than a triple capstan winch because of torque distribution throughout the gear train is improved and therefore the gear volume is lower because of better torque balance. One also has an improved, lower inertia.

It is not necessary for any particular capstan of one pair or set to be locked to a particular one of the other pair or set of capstans. For example, one may lock the first and last capstans of a traction unit having four capstans or one could lock all, for example. One could also hydraulically lock the two motors, for example by putting a flow divider control valve in the circuit.

As stated above, it is essential that the capstans in each pair are contra-rotatable or otherwise the necessary load balance between the two pairs or sets of capstans is not achieved.

Whilst epicyclic gears are highly preferred, they are not absolutely essential to the present invention. However, one must have a gearing capable of providing similar power/thrust characteristics.

At the present time, the smaller capstans of each pair or set are approximately two thirds that of the larger one of the same set. The relative sizes between the capstans in each pair or set is related to the gearing so that one can get the correct torque balance.

It will be appreciated that contra-rotation of the capstans of each pair or set, when epicyclic gear trains are used, converts a 2:1 ratio to 6:1 ratio which of course is very important from a size/weight point of view.

It will be appreciated that a traction unit comprising six capstans in two sets of three, each set being mounted on a common axis, with the outer capstans of each set being larger in diameter than the middle capstan is effectively equivalent to two traction units back-to-back, in that the traction unit with six capstans can be totally reversible if appropriately engineered. Ideally, the outer two capstans of each set should be strapped together, with the centre capstan in each set being appropriately linked, for example through a chain drive.

It is preferred, in a traction unit according to the present invention having four capstans (a quadruple capstan traction unit), that the degree of wrap on the first capstan is approximately 160°, the degree of wrap on the second capstan is approximately 220°, the degree of wrap on the third capstan is approximately 220° on the first turn and 180° thereafter, with the degree of wrap on the fourth capstan being approximately 180°, except on the last turn when it can be any desired value, normally about 90°. With this configuration, a load of say 100 tons on the wire prior to wrap around the first capstan is reduced to about 73 tons after wrap around the first capstan, is reduced to about 49 tons around the wrap of the second capstan, is reduced to about 33 tons after the first wrap of the first small capstan (i.e. the third capstan), when the ratio between the diameters of the first and third capstans (which are identical to the second and fourth capstans) is 3:2. Of course, the diameter of the larger capstan should be at least eighteen times the rope diameter, with the diameter of the smaller capstan being twelve times the rope diameter.

To obtain the desired wrap around of the first capstan, it is generally preferred to mount the quadruple capstan traction unit with a plane passing through the axes of the two pairs of capstans at an angle of approximately 20° to the horizontal, since in most uses the wire to the traction unit will be passing along a plane that is substantially horizontal.

Generally speaking, a traction unit in accordance with the present invention can be used anywhere where wire rope is used and will generally have advantages except where single layer drums are used. If desired, the traction units of the present invention can be provided with electrical, electro hydraulic or diesel hydraulic power units, can be used for deep and shallow mooring, pipe laying-recovery, dredging, mining or diving, whenever wire rope is used. The traction unit can be designed for fast response to control signals, invaluable in dynamic conditions, particularly bearing in mind the reduced inertia of the traction units of the present invention. Furthermore, one has a reduced torque input for a given line pull, as well as an extended wire life.

Attention is directed to British Pat. Specifications Nos. 1,448,059, 1,456,085, 1,101,131 and 1,101,132 which, in addition to the following specific description, may be of assistance to the experts in the art in understanding the principles behind the epicyclic gear trains used in the preferred embodiment of the invention described hereinafter.

It is preferred that each pair of capstans in a traction unit according to the present invention comprises a single groove pulley wheel and a contra-rotatable multi-groove drum approximately two thirds the diameter of the pulley wheel.

It will be appreciated that the use of a quadruple capstan traction unit allows the power to be split equally between two inputs driven by two motors, enables the gear trains in each drum assembly to be identical, with the power transmitted in the timing chain reduced, enables each standard rope size to have a standard drum and epicyclic gear size having constant face-dimensional face width and diameter ratios with volume directly proportional to torque, enables the volume of the gears to be minimised by differentially coupling such that all the gearing can be housed in the drum assemblies, and enables the bearing loads to be substantially the same for each drum assembly.

Figure 2:
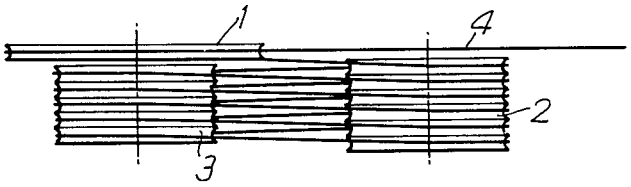
Figure 3:
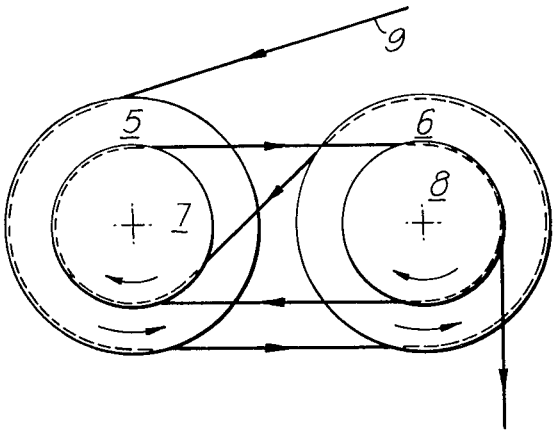
Figure 4:
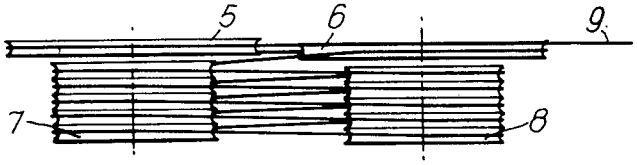
Figure 5:
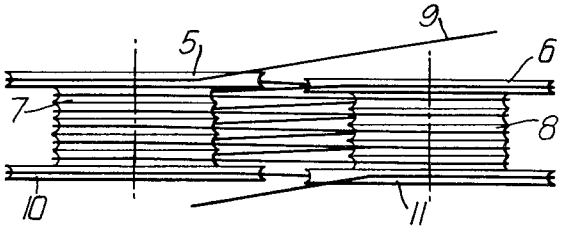
Figure 6:
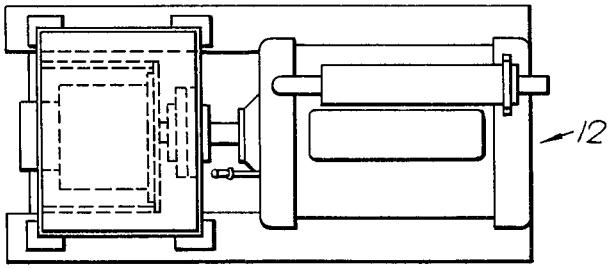
Figure 7:
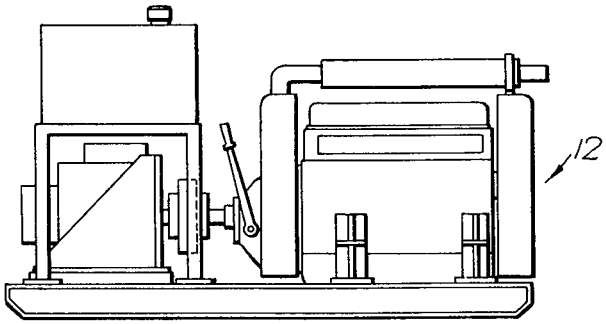
Figure 8:
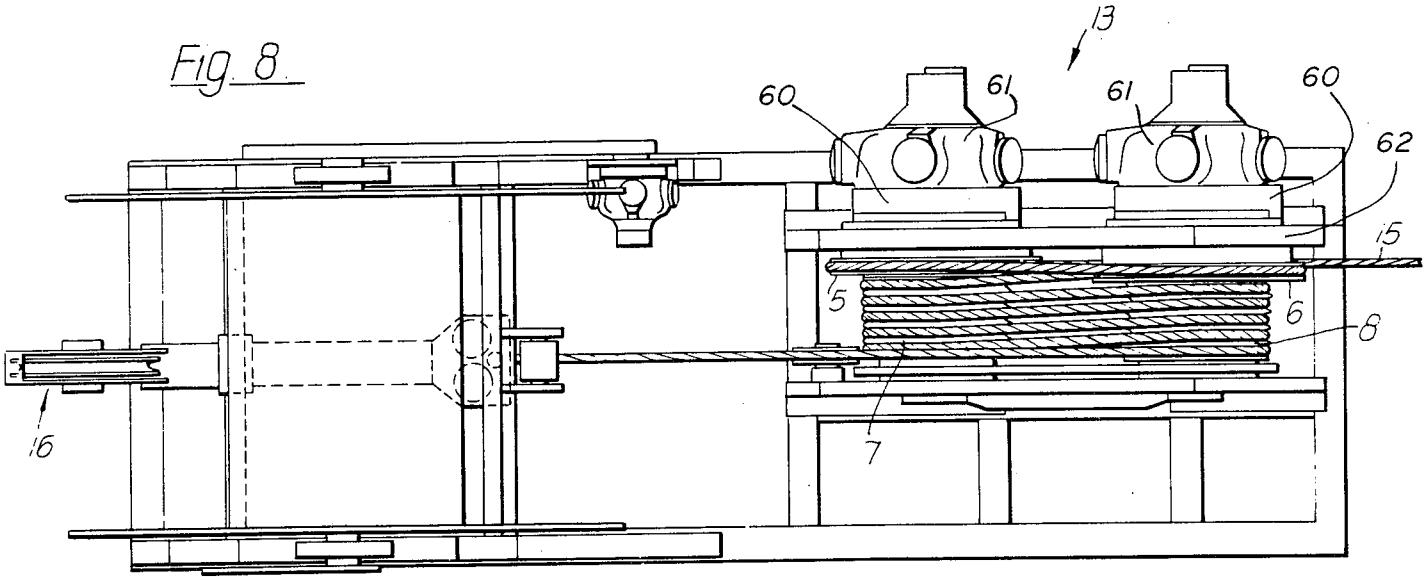
Figure 9:
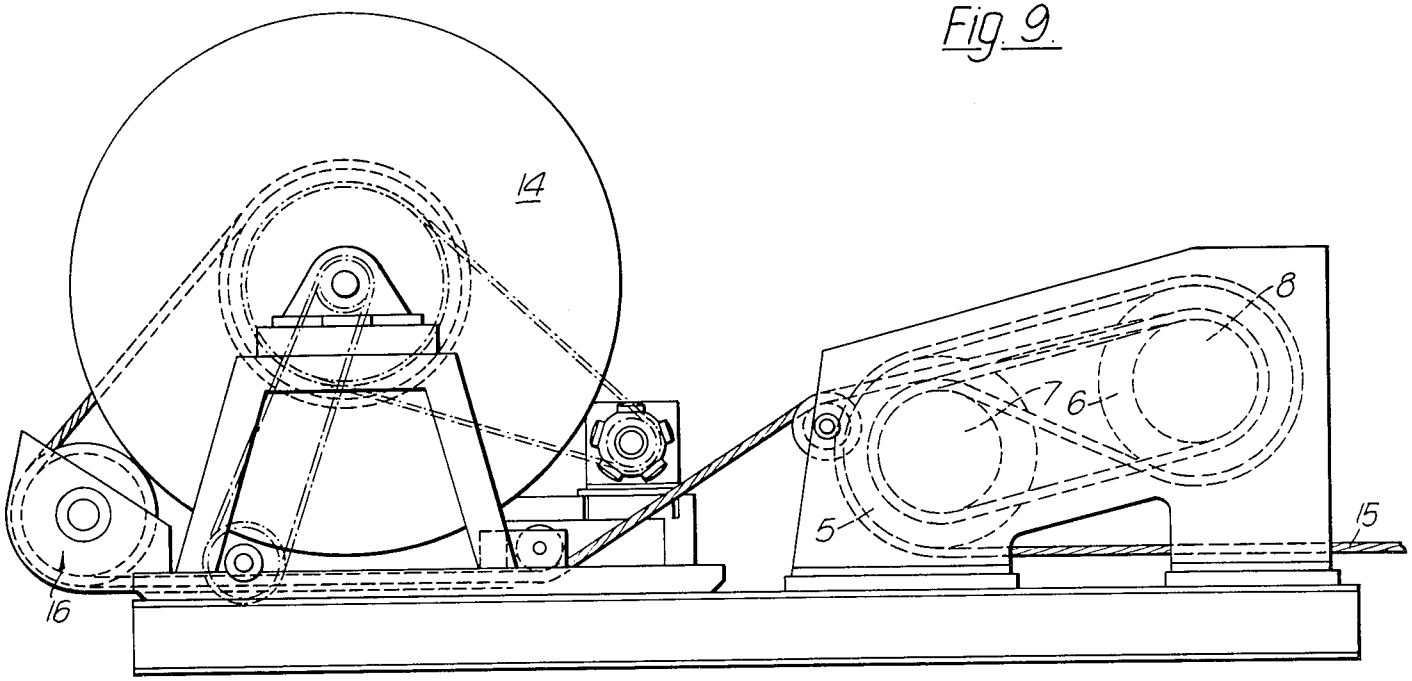
Figure 10:
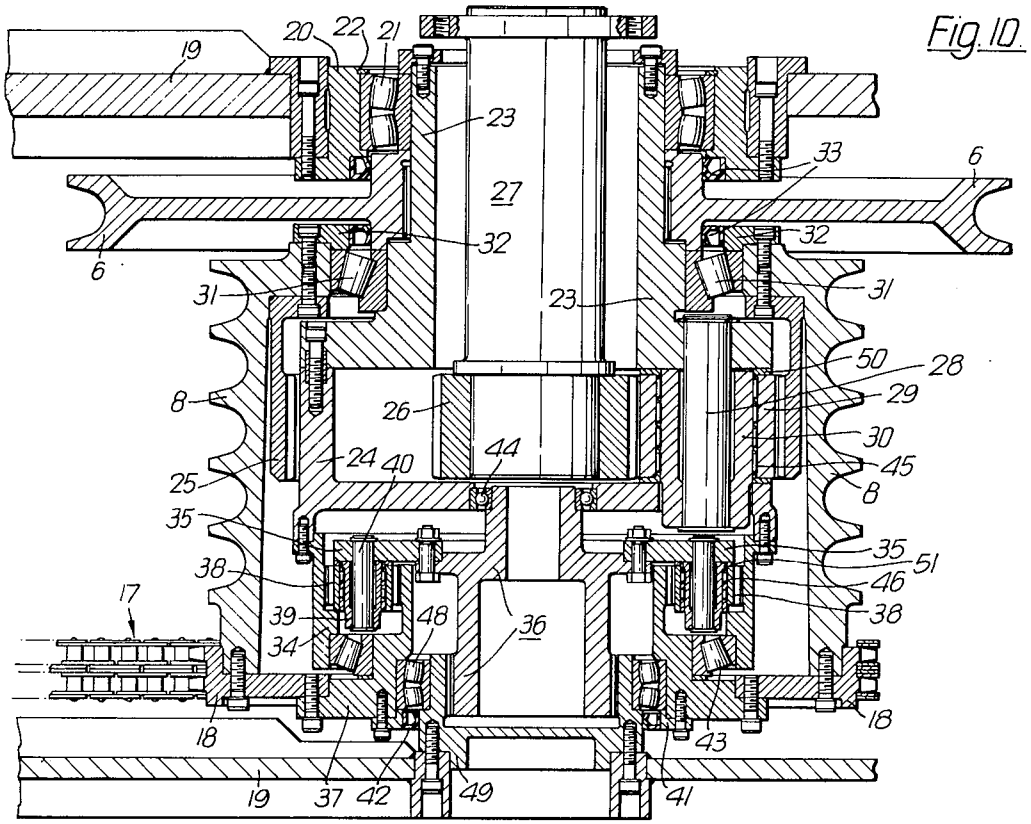
Figure 11:
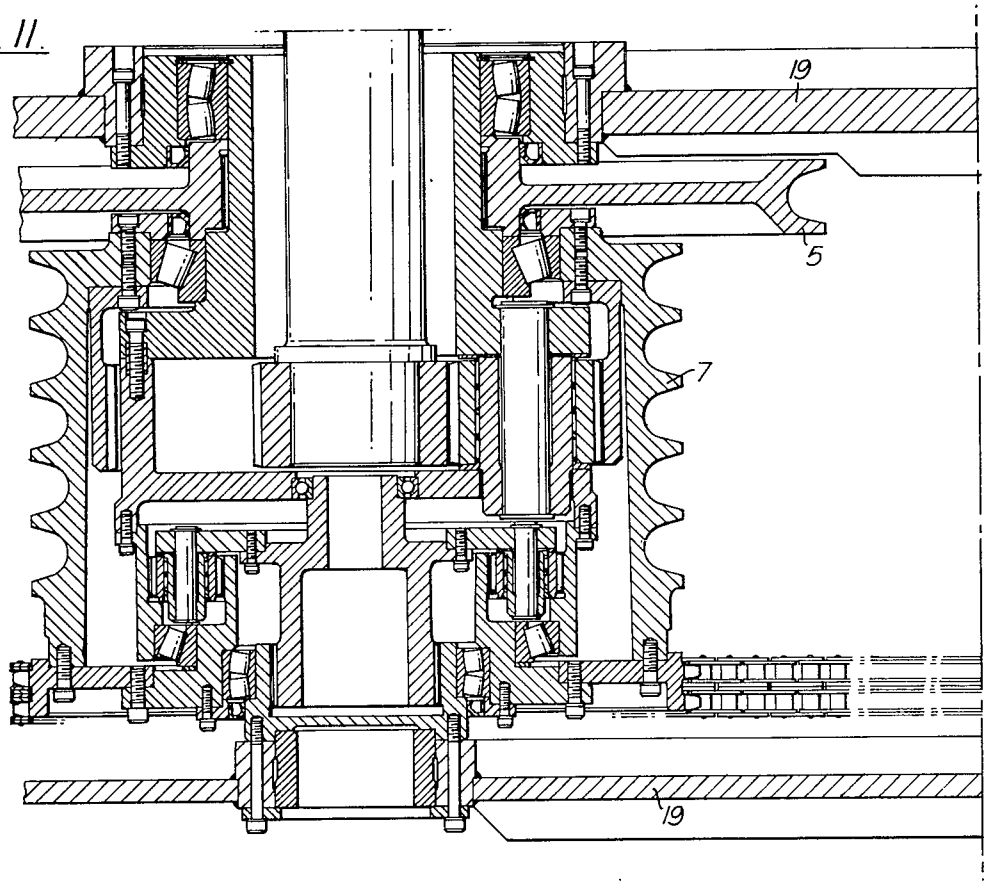
Figure 12:
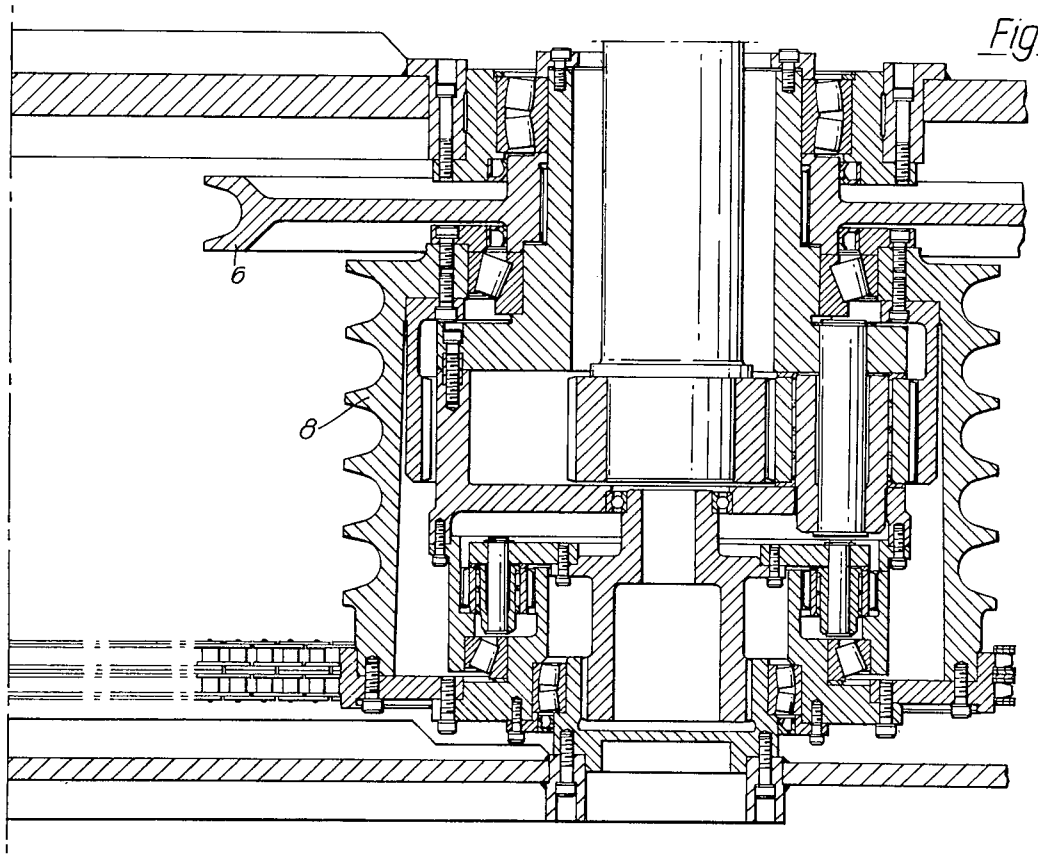
Figure 13:
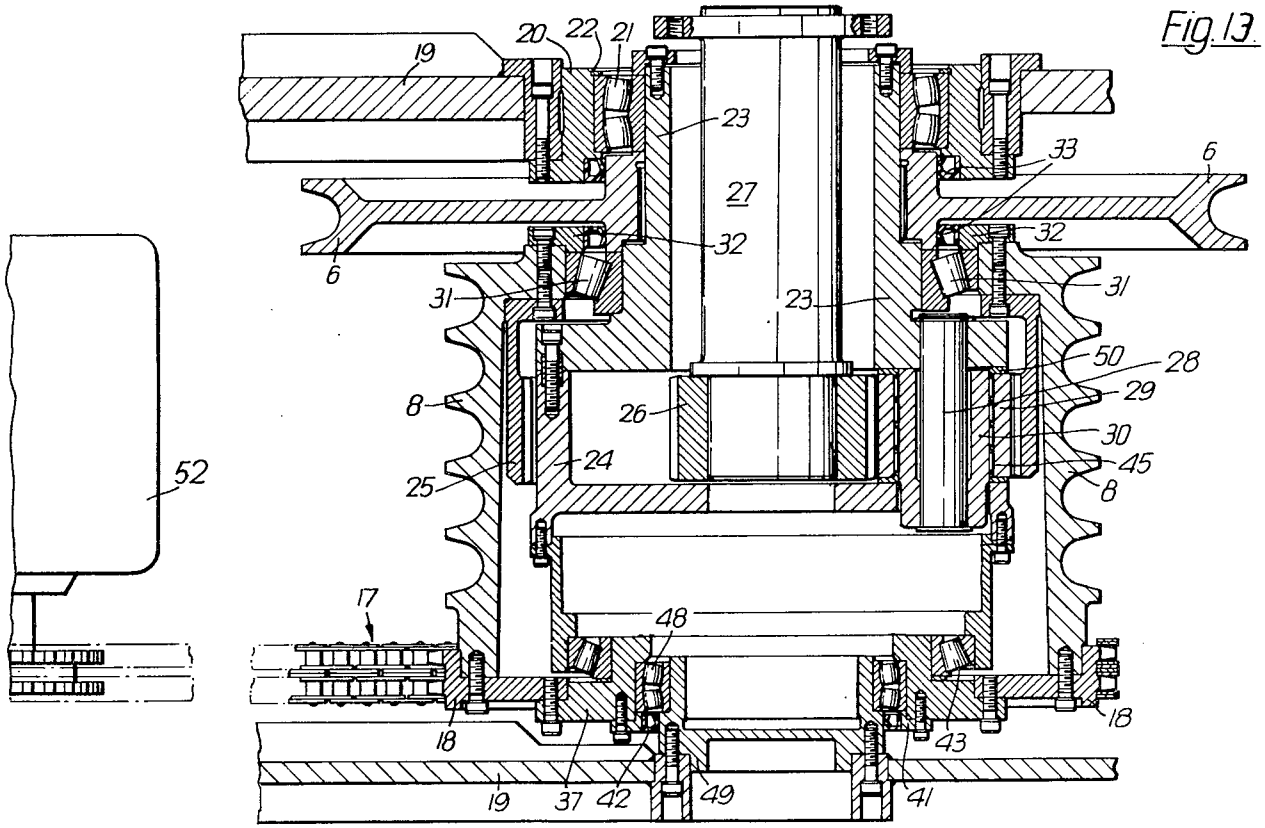

For a better understanding of the present invention and to show how the same may be carried into effect, reference will now be made, by way of example, to the accompanying drawings, in which:

FIG. 1 shows a diagrammatic side view of a triple capstan winch, not forming part of the present invention, FIG. 2 shows a diagrammatic plan view of a triple capstan winch, not forming part of the present invention, FIG. 3 shows a diagrammatic side view of a quadruple capstan traction unit in accordance with the present invention, FIG. 4 shows a diagrammatic plan view of a quadruple capstan traction unit in accordance with the present invention, FIG. 5 shows a diagrammatic plan view of a sextuple capstan traction unit in accordance with the present invention, FIGS. 6 and 7 respectively show a diagrammatic plan view and diagrammatic side view of a power pack for use with the present invention, FIG. 8 shows a diagrammatic underneath view of a quadruple capstan traction unit and storage drum in accordance with the present invention, FIG. 9 shows a side view corresponding to the plan view of FIG. 8, FIG. 10 shows a partial detailed view of a pair of capstans, with internal epicyclic gear train, of a pair of capstans of the quadruple capstan traction unit of FIGS. 8 and 9, FIGS. 11 and 12 together show the respective arrangement of the capstans and epicyclic gearing of the two pairs of capstans of the quadruple capstan traction unit of FIGS. 8 and 9, and FIG. 13 shows a view corresponding to FIG. 10, showing various modifications.

Figure 14:
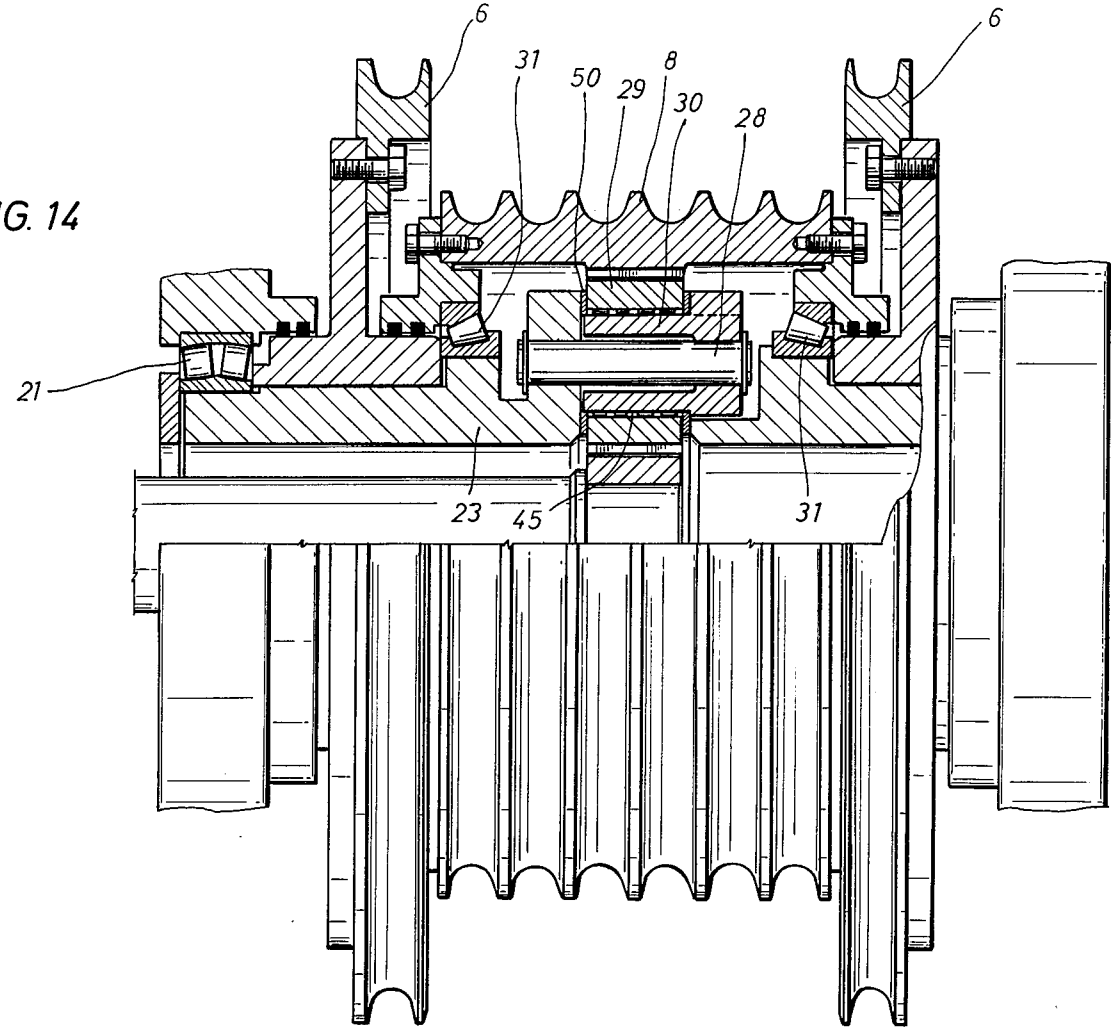

FIG. 14 shows the epicycloidal gear drive for the capstan arrangement shown in FIG. 5.

Referring now to the drawings, FIGS. 1 and 2 show a triple capstan traction unit. The first drum, of largest diameter, has a degree of wrap of rope 4 of approximately 220°, the second capstan 2 has a degree of wrap of approximately 220° on the first groove of the drum 2 which is multi-grooved, with the degree of wrap around the third capstan 3 and the remaining grooves of the drum 2 being approximately 180°, except for the last wrap of the rope. The diameter of capstan 1 is eighteen times that of the rope diameter, with the diameter of capstans 2 and 3 being twelve times the rope diameter. If a load of 100 tons, for example, is applied to the rope, the load will be reduced to about 65 tons after the wrap around capstan 1 and will be reduced to about 43 tons after the first wrap around capstan 2. It will be noted that capstans 1 and 3 are contra-rotating but that there is no balance of torque in respect of capstan 2.

Referring now to FIGS. 3 and 4, a rope 9 passes around a first larger diameter capstan 5, then around a second larger diameter capstan 6, then with crossover around a first smaller diameter capstan 7 and then around a second smaller diameter capstan 8, capstans 7 and 8 being multi-groove capstans with the capstans 5 and 6 being single groove pulley wheels. The degree of wrap of the rope is approximately 160° around the first pulley wheel 5, approximately 220° around the second pulley wheel 6, approximately 220° around the first groove of the first multi-groove drum 7 with a crossover so as to reverse the direction of the first multi-groove drum 7 with respect to the first pulley wheel 5 and approximately 180° around the first groove of the second multi-groove drum 8. The wrap then continues an appropriate number of further increments of 180° around the remaining grooves of the first and second multi-groove drums 7 and 8. If the diameter of capstans 5 and 6 is approximately eighteen times that of the rope diameter and the diameter of capstans 7 and 8 is approximately twelve times the rope diameter, a load of 100 tons applied to the rope to the first capstan 5 will be reduced to approximately 73 tons after the wrap therearound, then to approximately 49 tons after the wrap around the second larger capstan 6 and then is reduced to approximately 33 tons after the first wrap of the first multi-groove drum 7. It will be seen that the loads on the respective capstans result in an approximate torque balance on the pairs of capstans.

Referring now to FIG. 5 of the drawings, this shows a sextuple capstan traction unit which is effectively the quadruple capstan winch of FIGS. 3 and 4, with additional larger capstans 10 and 11, being identical to capstans 5 and 6, so that the unit is totally reversible and is specifically adapted for use in in line situations, for example in dynamic mooring, when it will be appreciated that the sextuple capstan winch of FIG. 5 could be used, in appropriate circumstances, in place of two quadruple capstan winches mounted "back-to-back".

FIGS. 6 and 7 diagrammatically illustrate an appropriate power pack for use in connection with a traction unit according to the present invention. Since such is conventional, further detail thereof will not be described.

Turning now to FIGS. 8 and 9 of the drawings, there is shown a quadruple capstan winch 13 according to the present invention with storage drum 14. The rope 15 approaches the quadruple capstan traction unit 13 at an angle of approximately 20° to a plane passing through the axes of the capstans of the traction unit, then passes about the capstans as described hereinabove in connection with FIGS. 3 and 4 and then passes to the storage drum 14 via an appropriate arrangement 16 to ensure satisfactory winding on the storage drum 14.

FIG. 8 also illustrates the brakes 60, hydraulic drives 61 and clutch 62 which may be used in the capstan of the instant invention.

Referring now to FIG. 10 of the drawings, there is shown a detailed sectional view of the epicyclic gearing of one pair of capstans 6 and 8, with a timing chain link provided between capstan 8 and the corresponding capstan 7 of the other pair of capstans (see FIGS. 11 and 12). The timing chain will normally be a Duplex chain 17 carried on Duplex sprocket 18.

To a frame 19 of the traction unit there is mounted a bearing housing 20 carrying, via barrel roller bearing 21 and circlip 22 a planet carrier 23 provided with carrier 24. Annulus gear 25 is mounted in the multi-groove capstan 8 and therein is mounted sun gear 26 on input shaft 27. On the planet carrier 23, via planet pin 28 is provided planet gear 29, with planet spindle 30 therebetween. Between the multi-groove capstan 8 and the planet carrier 23 is provided a taper roller bearing 31 and between the capstan 8 and the capstan 6 is provided a seal housing 32 and oilseal 33, an oilseal 33 likewise being provided between the capstan 6 and the bearing housing 20.

To the carrier 24 is fastened an annulus gear 34 having mounted therein planet carrier 35 to which is mounted reaction shaft 36. A sun gear 37 is fastened to the capstan 8 and a planet gear is provided between the annulus gear 34 and the planet carrier 35 via planet spindle 39 and planet pin 40. A seal housing 41 and seal 42 and barrel roller bearing 48 is provided between the sun gear 37 and a location boss 49. A taper roller bearing 43 is provided between the annulus gear 34 and the sun gear 37. Between the carrier 24 and the reaction shaft 36 is provided a ball bearing 44.

A needle bearing 45 is provided between the planet gear 29 and the planet spindle 30 and likewise a needle bearing 46 is provided between planet gear 38 and planet spindle 39.

A thrust ring 50 is provided between the end of the planet carrier 29 and the planet carrier 23. Likewise, a thrust ring 51 is provided between the planet gear 38 and planet carrier 35.

FIGS. 11 and 12, together, show capstans 5, 6, 7 and 8 with their respective epicyclic gear trains, which are as described above in connection with FIG. 10 and which will therefore not be described again. The respective relative positions of capstans 5 and 6 should be noted, as should the respective positions of the grooves or capstans 7 and 8. It will be noted in fact that the gear trains are identical although are slightly differently mounted in respect of the frame 19 because of the relative positions of the capstans 5, 6, 7 and 8.

FIG. 13 is similar to FIG. 10, except that a motor 52 has been provided on the chain 17 and the brake has been omitted from the epicyclic gear drive.

What we claim is:

1. A traction unit which comprises two pairs of two capstans for handling a common line, the capstans of each pair having a common axis and the axes of each pair being in separate and spaced apart parallel relationship to each other, one capstan of each pair of capstans being larger in diameter than the other capstan of that pair, cycloidal gears being provided between the capstans of each pair of the capstans to effect opposite rotation between the capstans in each pair, with one of the capstans of one pair being coupled to another capstan of the other pair of capstans to coordinate the rotation of said capstans.

2. A traction unit which comprises two pairs of two capstans for handling a common line, the capstans of each pair having a common axis and the axes of each pair being in separate and spaced apart relationship, one capstan of each pair of capstans being larger in diameter than and being oppositely rotatable to the other capstan of that pair, an epicycloidal gear drive being provided in each pair between the larger in diameter capstan and the other capstan of the pair, with a differential coupling between at least one capstan and another capstan of each pair.

3. The traction unit of claim 2, wherein each pair of capstans are identical.

4. The traction unit of claim 3, wherein the ratio of the diameter of the larger capstan of each pair is approximately 50% larger than the diameter of the other capstan of that pair.

5. The traction unit of claim 4, wherein the two larger capstans are single groove pulley wheels and the smaller capstans are oppositely rotatable multigroove drums.

6. The traction unit of claim 5, wherein the amount of wrap of rope about the first pulley wheel is approximately 160°, the degree of wrap around the second pulley wheel is approximately 220° and the degree of wrap around the first groove of the first multigroove drum is approximately 220° with a crossover so as to reverse the direction of the first multigroove drum with respect to the first pulley wheel and the degree of wrap around the first groove of the second multigroove drum is approximately 180°, the wrap then continuing approximately 180° of line wrap around the remaining grooves of the multigroove drums, with allowance for a different degree of wrap for the last groove engaged by the line.

7. The traction unit of claim 2, wherein a brake is incorporated in each cycloidal gear drive.

8. The traction unit of claim 2, wherein a clutch is incorporated in the cycloidal gear drive.

9. The traction unit of claim 2, wherein a motor is provided to transmit power to the differential coupling between the two pairs of capstans.

10. The traction unit of claim 2, wherein the differential coupling comprises a torque transfer/timing chain.

11. The traction unit of claim 2, wherein each pair of capstans is driven hydraulically, with the hydraulic drives being hydraulically locked by insertion of a flow-divider control valve in the hydraulic circuit.

12. A traction unit which comprises two sets of three capstans, the capstans of each set having a common axis and the axes of each set being in spaced apart parallel relationship, the two outer capstans of each set being larger in diameter than a middle capstan of the respective set and said two outer capstans being oppositely rotatable to the middle capstan of the respective set, an epicycloidal gear drive being provided between each larger in diameter capstan and the middle capstan of each set, with a differential coupling between at least one capstan and another capstan of each set.

13. A traction unit for handling a common line, comprising:

a first pair of capstans, having different diameters, mounted on a first axis;

a second pair of capstans, having different diameters, mounted on a second axis spaced from and parallel to said first axis;

first cycloidal gears coupling said first pair of capstans;

second cycloidal gears coupling said second pair of capstans, said first and second cycloidal gears thereby being adapted to oppositely rotate the capstans within said first and second pairs of capstans, respectively, at predetermined rates of rotation selected to balance the torque loading on each capstan within said unit; and a connecting drive link coupling one of said first pair of capstans with one of said second pair to coordinate the rotation of said first and second pairs of capstans.

14. A traction unit for handling a common line, comprising:

a first pair of capstans, having different diameters, mounted on a first axis;

a second pair of capstans, having different diameters, mounted on a second axis spaced from and parallel to said first axis;

a first epicycloidal gear drive coupling said first pair of capstans;

a second epicycloidal gear drive coupling said second pair of capstans, said first and second gear drives thereby being adapted to oppositely rotate the capstans within said first and second pairs, respectively, at predetermined rates of rotation selected to balance the torque loading on each capstan within the unit; and a differential coupling between one capstan of said first pair and one capstan of said second pair for coordinating the rotation of said first and second pairs of capstans.

15. The traction unit of claim 14, wherein said first pair of capstans is identical to said second pair of capstans.

16. The traction unit of claim 15, wherein said first epicycloidal gear drive is identical to said second epicycloidal gear drive.

17. The traction unit of claim 15, wherein the ratio of the diameters of the capstans within each pair is approximately 3:2.

18. The traction unit of claim 17, wherein the larger capstan of each pair comprises a single groove pulley wheel and the smaller capstan of each pair comprises an oppositely rotatable multi-groove drum.

19. The traction unit of claim 18, wherein said unit is adapted for:

160° of line wrap around the pulley wheel of said first pair;

220° of line wrap around the pulley wheel of said second pair;

220° of line wrap around a first groove of the multi-groove drum of said first pair, said line including a crossover to reverse the direction of rotation of the multi-groove drum of said first pair with respect to the pulley wheel of said first pair;

180° of line wrap around the remaining grooves of the multi-groove drums of said first and second pairs, with allowance for a different degree of wrap for the last groove engaged by the line.

20. The traction unit of claim 14, further comprising:

a first brake adapted to operate on said first epicycloidal gear drive; and a second brake adapted to operate on said second epicycloidal gear drive.

21. The traction unit of claim 14, further comprising:

a first clutch adapted to control said first epicycloidal gear drive; and a second clutch adapted to control said second epicycloidal gear drive.

22. The traction unit of claim 14, further comprising:

a motor adapted to transmit power to said differential coupling and thereby drive said unit.

23. The traction unit of claim 14, wherein said differential coupling comprises a timing chain.

24. The traction unit of claim 14, wherein said differential coupling further comprises:

a first hydraulic drive for rotating said first pair; and a second hydraulic drive for rotating said second pair.

25. A traction unit for handling a common line, comprising:

a first set of three capstans, with the middle capstan smaller in diameter than the outer capstans, mounted on a first axis;

a second set of three capstans, with the middle capstan smaller in diameter than the outer capstans, mounted on a second axis spaced from and parallel to said first axis;

at least one epicycloidal gear drive coupling the outer capstans with the middle capstan of said first set;

at least one epicycloidal gear drive coupling the outer capstans with the middle capstan of said second set, said gear drives being adapted to oppositely rotate the capstans within said first and second sets at predetermined rates of rotation selected to balance the torque loading on each capstan; and a differential coupling between one capstan of said first set and one capstan of said second set for coordinating the rotation of said first and second sets of capstans.

* * * * *